United States Patent [19]

Robinson

[11] 4,067,157

[45] Jan. 10, 1978

[54] ELEMENTS FOR FORMING FRAMES

[75] Inventor: Brian Robinson, Usk, England

[73] Assignee: Catnic Components Limited, Caerphilly, Wales

[21] Appl. No.: 613,167

[22] Filed: Sept. 15, 1975

[30] Foreign Application Priority Data

| | | |
|---|---|---|
| Sept. 23, 1974 | United Kingdom | 41345/74 |
| June 2, 1975 | United Kingdom | 23796/75 |

[51] Int. Cl.[2] ..... E06B 1/04; E04C 2/38

[52] U.S. Cl. ..... 52/127; 49/504; 52/213; 52/656; 403/231

[58] Field of Search ..... 52/213–217, 52/656, 758 H, 127; 403/231, 241, 295; 49/504

[56] References Cited

U.S. PATENT DOCUMENTS

| | | | |
|---|---|---|---|
| 1,795,326 | 3/1931 | Baum | 403/231 |
| 3,156,331 | 11/1964 | Sklar | 52/217 X |
| 3,726,552 | 4/1973 | Widerby | 403/295 X |
| 3,769,773 | 11/1973 | Mochizuki | 52/656 |
| 3,884,003 | 5/1975 | Herr et al. | 52/212 |
| 3,889,423 | 6/1975 | Begin | 49/504 |

FOREIGN PATENT DOCUMENTS

| | | | |
|---|---|---|---|
| 1,108,066 | 8/1955 | France | 52/213 |

*Primary Examiner*—Alfred C. Perham
*Attorney, Agent, or Firm*—Blanchard, Flynn, Thiel, Boutell & Tanis

[57] ABSTRACT

Elements for forming a frame such as a metal door frame having spring clips by which a head rail and side members are connected, and a spacer or tie bar by which the elements can be stabilized during erection of the frame in a door way.

11 Claims, 29 Drawing Figures

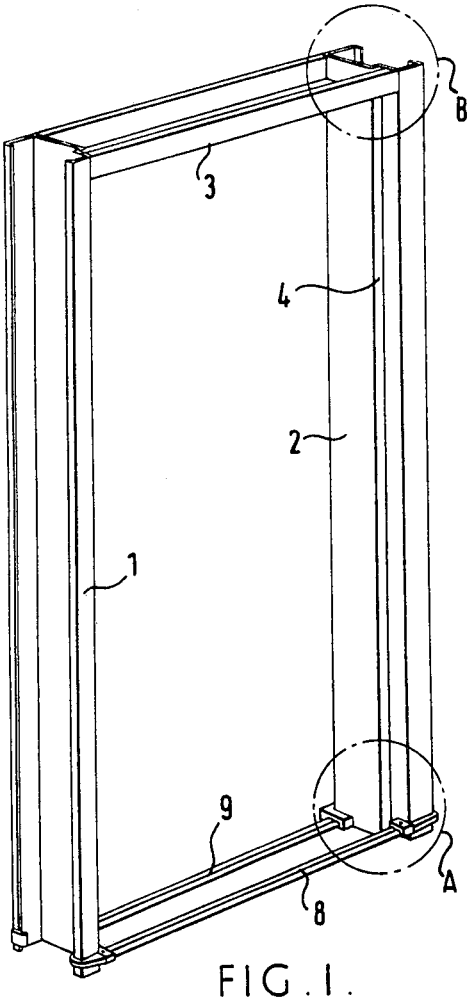
FIG. 1.
FIG. 2.
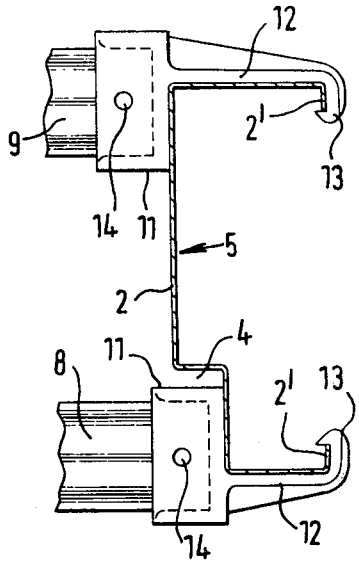
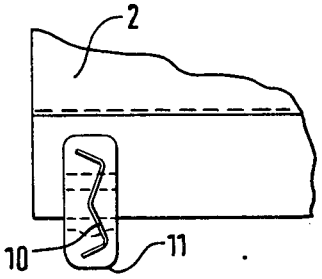
FIG. 3.
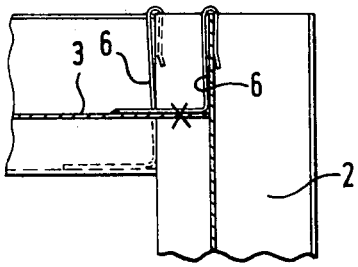
FIG. 5.
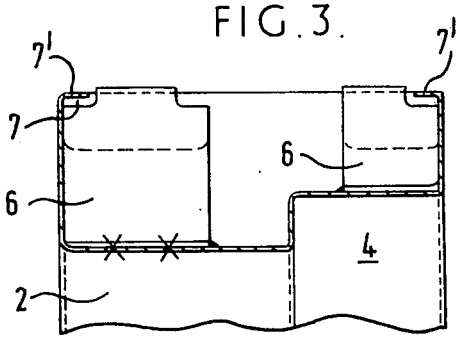
FIG. 6.

ELEMENTS FOR FORMING FRAMES

The invention relates to improvements in and relating to elements for forming frames, particularly door frames.

It is generally an object of the invention to provide a metal door frame for defining a doorway through an opening in a wall, comprising a pair of door jambs and a head rail, each of said jambs and said head rail having a substantially identical channel-shaped cross-section comprising opposed flanges connected by a web, said flanges being directed away from said opening towards the body of said wall, and securing means secured to the head rail and including a bracket at the free end thereof, said bracket having a body of L-shaped cross-section, one limb and said L-shaped body being secured to the head rail and the other limb of said L-shaped body extending upwardly from the end edge of the web of said head rail in a plane at substantially right angles to the length axis of the head rail, said upward extending bracket limb fixedly supporting a spring clip leg extending convergently downward from the upper edges of said upward extending bracket limb close along the onboard face of the latter for snugly receiving and resiliently gripping therebetween the upper edge portion of the web of the adjacent jamb thereby supporting and resiliently securing said head rail on said jamb.

It is also an object of the invention to provide a spacer or tie bar adapted by removable means for temporary mounting on a pair of members when the pair is erected. The removable means may comprise a bracket adapted for engagement with one member and with an end of the spacer or tie bar.

The bracket may include a slot having a profile of similar configuration to the cross-section of the spacer or tie bar, so that the bar can be received as a push fit in it. The bracket may also include hook-like means adapted to engage with snap or clip-like engagement with an edge of the member.

The securing means may comprise spring clips secured to either the members of the pair of members or to the third member.

Elements embodying the invention are diagrammatically illustrated, by way of example, in the accompanying drawings, in which:

FIG. 1 shows a perspective view of a frame assembled from the elements;

FIG. 2 is an enlarged plane view, partly in section, of the part marked "A" in FIG. 1;

FIG. 3 is a view in the direction of the arrow "X" in FIG. 2;

FIGS. 4A to 4F show different views of tie bars in plan, FIG. 4A showing a plan view of a blank and FIGS. 4B and 4C showing plan views of two different tie bars of which FIGS. 4D and 4E are corresponding end elevations, while FIG. 4F shows a plan view of frame elements connected by two tie bars;

FIG. 5 is an enlarged elevational view, partly in section, of the part marked "B" in FIG. 1;

FIG. 6 is a view in the direction of arrow "Y" in FIG. 5;

Figure 7:
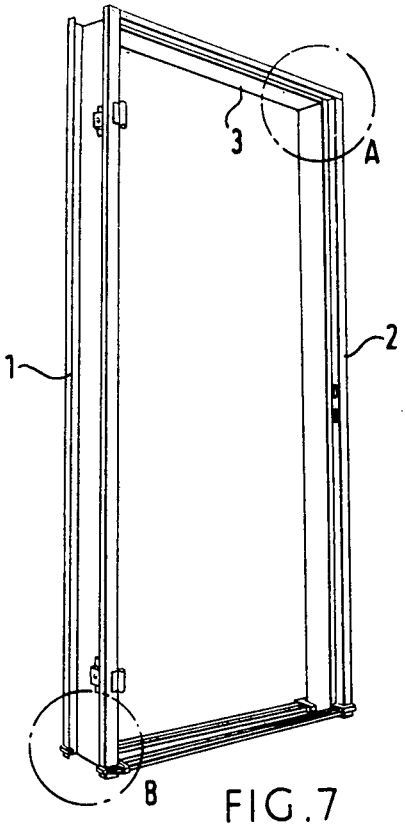
FIG. 7 shows a metal door frame assembled from separate elements which include hinge means.
Figure 7A:
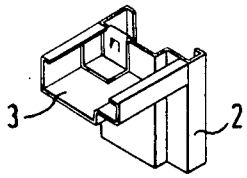
Figure 7B:
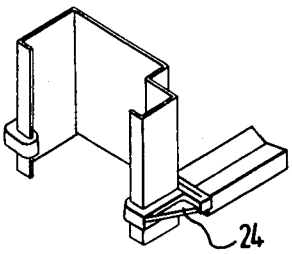
Figure 8:
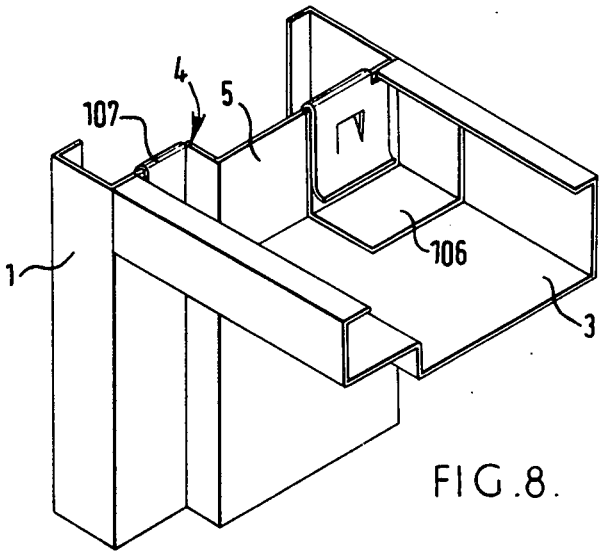
Figure 9B:
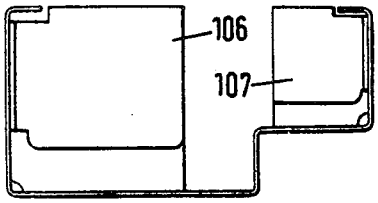
Figure 10A:
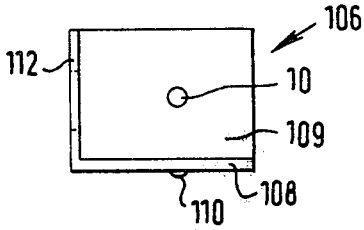
Figure 9A:
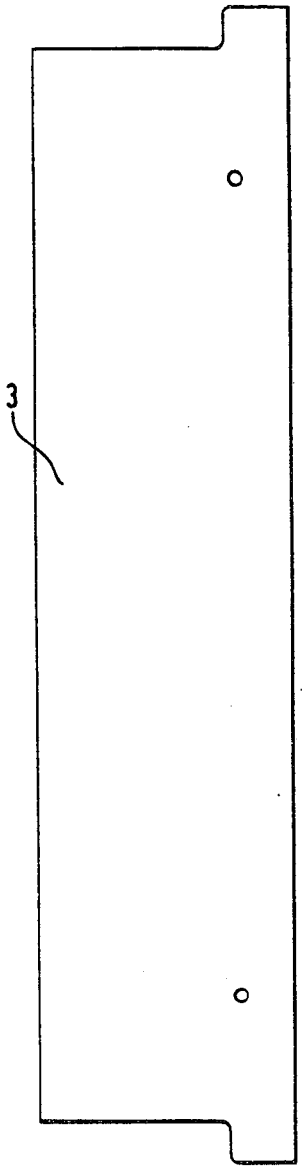
Figure 10B:
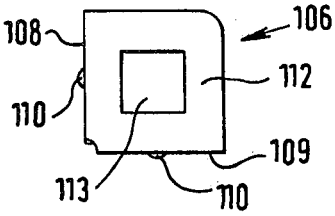
Figure 11A:
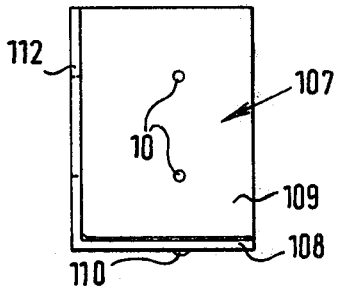
Figure 11B:
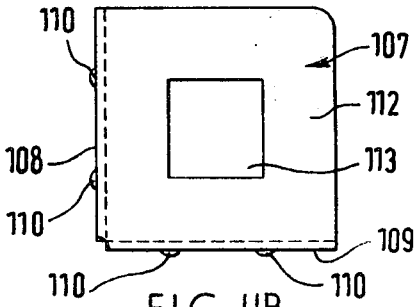

FIGS. 7A and 7B respectively show enlarged perspective views of details A and B of FIG. 7;

FIG. 8 shows a view similar to FIG. 7A but on a larger scale;

FIGS. 9A and 9B show plan and elevational views of a head rail or bar for the door frame of FIGS. 7 and 8;

FIGS. 10A and 10B show side and end elevational views of a corner bracket;

FIGS. 11A and 11B shows views similar to FIGS. 10A and 10B of a slightly modified bracket;

FIGS. 12A to 12D show respective front elevational, and plan views of a headbar retaining clip; and FIGS. 13A to 13D show views similar to FIGS. 12A to 12D of a slightly modified clip, on a smaller scale.

Referring to the drawings, elements for forming a frame such as a door frame suitably comprise a pair of metal side members 1 and 2 and a metal head beam or top rail 3 each of generally channel configuration and having a rebate 4 in the web of the respective channels. The hand beam or top rail 3 has a cut-out or recess at each end in order to accommodate the major portion 5 of the respective side members. A pair of spring clips, or brackets, 6 is secured as by welding at either side of and at each end of the head beam 3, the clips being adapted for securing the side members to the head beam or top rail (FIGS. 5 and 6). Each clip has a rebated portion 7 to accomodate a lip 7' of the top bar.

It will be understood that the members are assembled merely by pushing the side members to engage in the clip members. Alternatively, the spring clip members could be mounted on the side members, for receiving the head beam.

To stabilize the frame during erection and building into a wall or other structure, one tie bar or in this case a pair of spacer or tie bars 8 and 9 span the gap between the side members. Each spacer or tie bar 8 or 9 is mounted as by a push fit in a slot 10 of complementary shape, with a flared entry or mouth, in a bracket 11 which has a body in which the slot is formed and an extension 12 terminating in a hook 13 which can be clip engaged round a leg and lip 2' of a side member. It will be understood that the length of the extension 12 corresponds substantially with the length of a leg of the channel section forming the side member. The spacer bar may be secured at each end in respective clips by a screw through a screw hole 14.

Figure 4A:
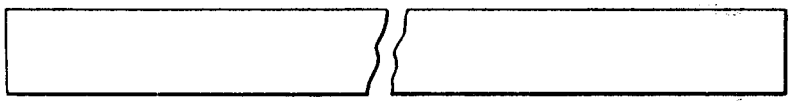
Figure 4B:
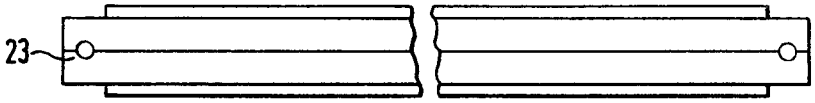
Figure 4C:
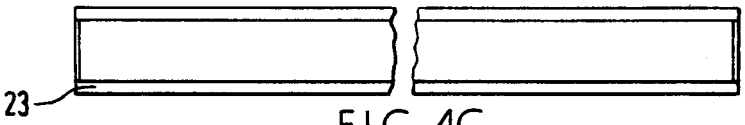
Figure 4D:
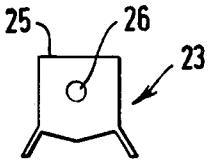
Figure 4E:
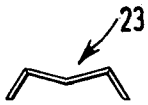
Figure 4F:
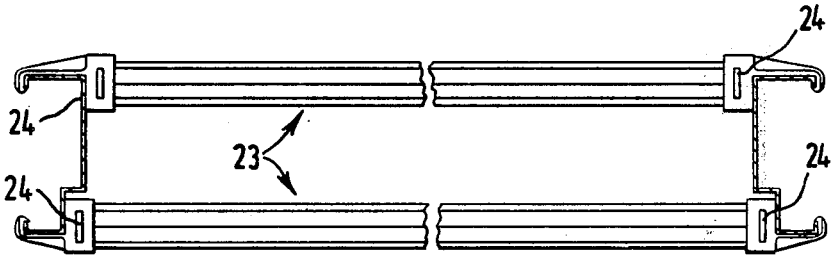

The tie bars shown in FIGS. 4B and 4F may be pressed and cut from the mild steel blank of FIG. 4A. Each end of each tie bar 23 is received in a bracket 24 which can be clipped to the side member as shown in FIGS. 1 and 4F. The tie bar shown in FIGS. 4D and 4E has an upstanding bracket 25 with a hole 20 so that it can be screwed to an upright of the element 1 or 2. As in FIG. 2 where a pair of tie bars is used, there is a longer one and a shorter one (FIG. 4F) the longer one extending into the rebated portion of the element. The bars have a generally flat "W" shape, the web being in two parts each to which is inclined at 22½ to the horizontal.

In use, the two spacer bars, or only one, are placed in position at any height of the frame by engaging the hooks around their respective lips, so stabilising the frame. The brackets and tie bars are simply removed by pulling away from the respective side members when the frame is firmly mounted in the wall or other structure.

It will be understood that the extension and hook are resilient and may be made from a material such as plastics. Moreover the whole bracket may be made in one piece from material such as plastics.

Referring now to FIGS. 7 to 13D, there is shown a pair of brackets comprising a larger 106 and a smaller corner bracket 107 secured as by being welded at each end of the head bar 3.

Each bracket has an L-shape body with limbs 108 and 109 for securing, as by welding, respectively to the web and the adjacent flange of the head bar 3. A single dome 110 (FIG. 10A) or a pair (FIG. 11A) of domes 110 assist the welding step. The brackets also have a plate or further limbs, 112 which has a central hole 113, which in the embodiments shown in square, punched therefrom. The plate 112 lies generally in a plane passing at right angles through the adjacent edge of the head bar.

Figure 12A:
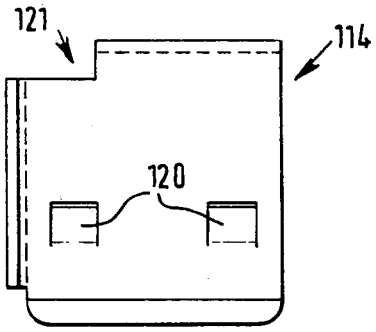
Figure 12B:
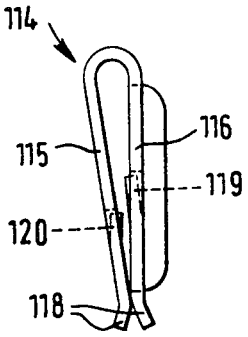
Figure 12C:
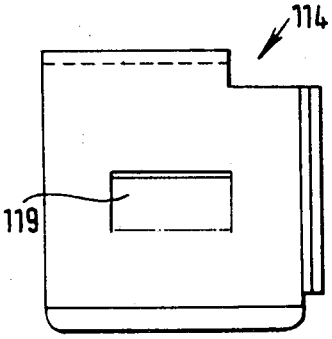
Figure 12D:
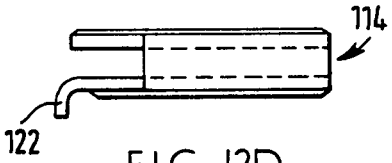
Figure 13A:
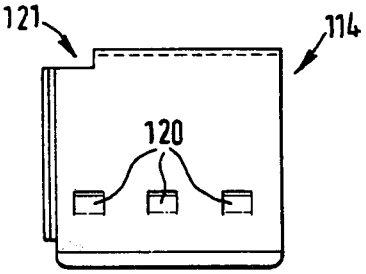
Figure 13B:
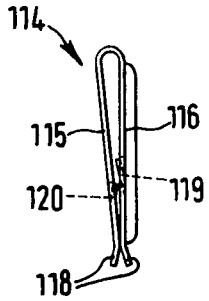
Figure 13C:
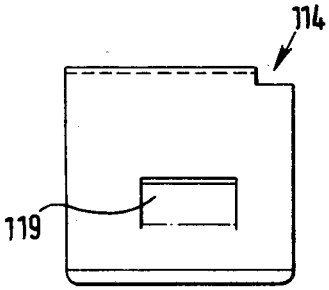
Figure 13D:
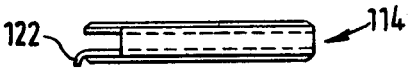

Spring retaining clips 114, for example made of spring steel, are of generally U-configuration with limbs 115 and 116 which touch near their free edges in the closed condition (FIGS. 12B and 13B). The limb 116 is substantially vertical, the other limb 115 converging towards it. Each limb terminates at its free edge in a flange 118, the flanges 118 diverging so that a divergent entry to the space between the limbs is formed.

The vertical limb also has a locking tab 119 punched therefrom and which is directed inwardly into the space between the legs.

The other limb has two (FIG. 12A) or three (FIG. 13A) locking tabs 120 punched therefrom and also directed inwardly into the space between the legs.

Each clip 114 has a rebate 121 for accommodating a lip of the head bar, and a flange 122 for contacting an adjacent flange of the head bar.

The spring retaining clips are also constructed to be of opposite hand to the configuration shown so that they can be mounted at either end of the head bar.

In use, a spring clip 114 is pushed downwardly over the plate 112 so that the locking tap 119 snaps into the hole 113, its free edge engaging the upper part of the plate bordering the hole. The plate is then held between the limbs of the clip and can grip a side element of the door frame when this element is pushed upwardly into the space between the legs of the clip and is gripped by the locking tabs. It will be understood that as the legs of the spring clips tend to close to the position shown in FIGS. 13B, the side elements and head bar are securely fixed together in the assembled condition.

It will be understood that the brackets and retaining clips are secured together as described before the bracket is welded to the head rail.

I claim:

1. A metal door frame for defining a doorway through an opening in a wall, comprising:

a pair of door jambs and a head rail, each of said jambs and said head rail having a substantially identical channel-shaped cross-section comprising opposed flanges connected by a web, said flanges being directed away from said opening towards the body of said wall; and a bracket secured to the free end of the head rail, said bracket having a body of L-shaped cross-section, one limb of said L-shaped body being secured to the head rail and the other limb of said L-shaped body extending upwardly from the end edge of the web of said head rail in a plane at substantially right angles to the length axis of the head rail, said bracket further incorporating a spring clip leg having an upper portion integrally continuing from the upper end of said upward extending bracket limb, said spring clip leg extending convergently downward from the upper edge of said upward extending bracket limb close along the outboard face of latter for snugly receiving and resiliently gripping therebetween the upper edge portion of the web of the adjacent jamb, thereby securing said head rail on said jamb, said upward extending limb and spring clip leg including opposed portions spaced not more than the thickness of the web of the adjacent jamb, said spring clip leg being resiliently bendable away from said outboard face of said upward extending body limb.

2. The door frame construction of claim 1, including removable clip on tie bar means, said tie bar means comprising a tie bar and tie bar receiving brackets for removable clip on attachment to the door jambs whereby when said tie bar receiving brackets are mounted at opposite sides of the opening facing one another and a tie bar is mounted therein, the door jambs are stabilized.

3. The door frame construction of claim 2, wherein the said tie bar receiving bracket has a hook part for hooking round part of a door jamb and a body part having a slot facing into the opening, in which slot an end of said tie bar is received, and in which said hook part is resilient for removal from the door jamb simply by pulling away.

4. The door frame construction of claim 3, wherein said slot and said tie bar have a generally "W" cross-section.

5. The door frame construction of claim 1, wherein said spring clip leg terminates in a lower free edge diverging away from said upward extending bracket limb, to guide insertion of said jamb web upward therebetween.

6. The door frame construction of claim 5, wherein said spring clip leg joins said upward extending bracket limb in a downwardly opening U-shape wide enough to receive the upper end of said jamb web, said spring clip leg extending downward well beyond said U-shape and being a substantial fraction of the height of said upward extending bracket limb.

7. A metal door frame for defining a doorway through an opening in a wall, comprising:

a pair of door jambs and a head rail, each of said jambs and said head rail having a substantially identical channel-shaped cross-section comprising opposed flanges connected by a web, said flanges being directed away from said opening towards the body of said wall; and securing means secured to the head rail and including a bracket at the free end thereof, said bracket having a body of L-shaped cross-section, one limb of said L-shaped body being secured to the head rail and the other limb of said L-shaped body extending upwardly from the end edge of the web of said head rail in a plane at substantially right angles to the length axis of the head rail, said upward extending bracket limb fixedly supporting a spring clip leg extending convergently downward from the upper edge of said upward extending bracket limb close along the outboard face of the latter for snugly receiving and resiliently gripping therebetween the upper edge portion of the web of the adjacent jamb, thereby securing said head rail on said jamb, the end edge of the head rail being contoured to the cross section of said jamb to snugly receive the jamb, the jamb extending substantially to the tops of the flanges of the head rail, said head rail flanges having an inturned lip at the upper end of said jamb, said upward extending limb of said bracket being the height of said head rail flanges.

8. The door frame construction of claim 7, in which one side of said bracket lies snug against the corresponding head rail flange and jamb web edge, said upward extending limb of said bracket being rebated adjacent its top edge to receive said inturned top lip of said head rail, said head rail web being stepped nonsymetrically in cross section, there being a pair of said brackets fixed at one end of said head rail on different height parts of said web, the heights of the upstanding legs of said pair of brackets differing sufficiently that said spring legs of said two brackets are on substantially the same level.

9. A metal door frame for defining a dorway through an opening in a wall, comprising:

a pair of door jambs and a head rail, each of said jambs and said head rail having a substantially identical channel-shaped cross-section comprising opposed flanges connected by a web, said flanges being directed away from said opening towards the body of said wall; and securing means secured to the head rail and including a bracket at the free end thereof, said bracket having a body of L-shaped cross-section, one limb of said L-shaped body being secured to the head rail and the other limb of said L-shaped body extending upwardly from the end edge of the web of said head rail in a plane at substantially right angles to the length axis of the head rail, said upward extending bracket limb fixedly supporting a spring clip leg extending convergently downward from the upper edge of said upward extending bracket limb close along the outboard face of the latter for snugly receiving and resiliently gripping therebetween the upper edge portion of the web of the adjacent jamb, thereby securing said head rail on said jamb, said spring clip leg being the outboard one of two opposed, and upper edge joined, legs of a U-cross-section spring clip which straddles said upward extending bracket limb and including a snap fit connection means securing the inboard one of said spring clip legs to said upward extending bracket limb for positively preventing separation therebetween upon insertion of said jamb web upward between said bracket and outboard spring clip leg.

10. The door frame construction of claim 9, wherein said upward extending limb of a given said bracket has a hole therethrough, and including a spring retaining clip which is of generally U-shaped in cross-section and which has convergent legs each of which has a locking tab, a said locking tab of one leg engaging and locking against one boundary surface of said hole when the spring retaining clip is pushed onto said upward extending limb of said bracket whereby the spring retaining clip is secured in position on said head rail and the other leg of said retaining clip being said spring clip leg and defining with said other limb of said bracket a recess in which said free upper edge of an adjacent door jamb is receivable.

11. The door frame construction of claim 9, in which each bracket has a third limb, said three limbs of said bracket lying in three intersecting and substantially perpendicular planes, corresponding to the head rail web, the adjacent jamb web and the adjacent flange of the head rail, said third limb being secured to the adjacent upstanding flange of the head rail.

* * * * *

UNITED STATES PATENT AND TRADEMARK OFFICE

CERTIFICATE OF CORRECTION

PATENT NO. : 4 067 157

DATED : 78 January 10

INVENTOR(S) : Brian Robinson

It is certified that error appears in the above-identified patent and that said Letters Patent are hereby corrected as shown below:

Column 3, line 67; after "of" insert ---the---.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*